US008451076B2

(12) United States Patent
Wendel et al.

(10) Patent No.: US 8,451,076 B2
(45) Date of Patent: May 28, 2013

(54) INSTALLATION SWITCHING DEVICE

(75) Inventors: Joachim Wendel, Sinsheim (DE); Roland Ritz, Dielheim (DE); Joachim Becker, Schwetzingen (DE)

(73) Assignee: ABB AG, Mannheim (DE)

( * ) Notice: Subject to any disclaimer, the term of this patent is extended or adjusted under 35 U.S.C. 154(b) by 0 days.

(21) Appl. No.: 13/353,862

(22) Filed: Jan. 19, 2012

(65) Prior Publication Data

US 2012/0182096 A1 Jul. 19, 2012

(30) Foreign Application Priority Data

Jan. 19, 2011 (DE) ..... 10 2011 008 829

(51) Int. Cl.
*H01H 75/00* (2006.01)
*H01H 77/00* (2006.01)
*H01H 83/00* (2006.01)

(52) U.S. Cl.
USPC ..... 335/18; 335/6; 335/16

(58) Field of Classification Search
USPC ..... 335/6, 14, 16, 18, 132
See application file for complete search history.

(56) References Cited

U.S. PATENT DOCUMENTS

| | | | | |
|---|---|---|---|---|
| 3,815,059 | A * | 6/1974 | Spoelman | 335/16 |
| 4,458,224 | A * | 7/1984 | Kralik et al. | 335/16 |
| 5,159,304 | A * | 10/1992 | Yamagata et al. | 335/202 |
| 2012/0182095 | A1 * | 7/2012 | Wendel et al. | 335/18 |

FOREIGN PATENT DOCUMENTS

| | | | |
|---|---|---|---|
| DE | 10 2008 006 863 | A1 | 1/2009 |
| WO | WO 2010/130414 | A1 | 11/2010 |
| WO | WO 2010/133346 | A1 | 11/2010 |

* cited by examiner

*Primary Examiner* — Bernard Rojas
(74) *Attorney, Agent, or Firm* — Buchanan Ingersoll & Rooney PC

(57) ABSTRACT

A current path in an installation switching device includes first and second contact points, which respectively include first and second levers. The second lever is arranged in an air gap in a magnetic circuit. In case of a short circuit, an electrodynamic force, which leads to rapid opening of the second contact point, can act on the second lever due to interaction of current flow with magnetic flux within the air gap. A switching mechanism acts via a first connecting line on the first lever to open and/or keep open the first contact point. In case of overcurrent tripping, an overcurrent release acts through the switching mechanism and a second connecting line on the switching mechanism to open and keep open the first contact point. In case of short-circuit tripping, the second lever acts via a third connecting line on the switching mechanism to keep the first contact point open.

21 Claims, 2 Drawing Sheets

INSTALLATION SWITCHING DEVICE

RELATED APPLICATION

This application claims priority under 35 U.S.C. §119 to German Patent Application No. 10 2011 008 829.6 filed in Germany on Jan. 19, 2011, the entire content of which is hereby incorporated by reference in its entirety.

FIELD

The present disclosure relates to an electrical installation switching device. More particularly, the present disclosure relates an installation switching device which achieves a fast and reliable disconnection of short-circuit current, and to such an installation switching device which can be installed in a 19-inch rack insert.

BACKGROUND INFORMATION

Installation switching devices may, for example, be circuit breakers, residual current devices, motor protection switches or selective main line circuit breakers.

By way of example, one circuit breaker of this type is disclosed in DE 10 2008 006 863 A1. In a circuit breaker such as this, a short-circuit current is disconnected with the aid of an impact-type armature. The field of a magnet coil, through which the current flows, excites the magnetic circuit within the electromagnetic short-circuit current release, and the impact-type armature is thus moved by electrodynamic interaction. The impact-type armature is coupled to a striking pin which strikes the contact lever such that the contact point is opened, and which at the same time acts on the switching mechanism, leading to unlatching of the switching mechanism and therefore to the contact point being kept permanently open, until the switching mechanism is latched again, only after which can the contact point be closed again.

In known installation switching devices, overcurrent tripping takes place with the aid of a thermomechanical tripping element, generally a thermal bimetallic strip. The overcurrent causes heating of the thermal bimetallic strip, resulting in the strip bending. In the bent state, the thermal bimetallic strip unlatches the switching mechanism by an appropriate link by means of a switching mechanism operating element, in response to which the contact point is likewise permanently opened until the switching mechanism is latched again, only after which can the contact point be closed again.

The switching mechanism disclosed in DE 10 2008 006 863 A1 has a latching point which is formed between a tripping lever and a latching lever. In addition, an intermediate lever is provided, which interacts with a contact lever. Furthermore, a switching handle is provided, which is coupled via a bracket to the intermediate lever, with the intermediate lever being mounted such that it can move relative to the latching lever. When the latching point is latched, a rigid lever chain is formed from the switching handle via the bracket and the intermediate lever to the contact lever. When the latching point is unlatched, the rigid coupling collapses and the intermediate lever can be moved relative to the latching lever. The latching point can be unlatched by acting on the tripping lever in order to pivot it such that the latching point is unlatched. For this purpose, DE 10 2008 006 863 A1 provides a striking lever, which acts on the tripping lever when it pivots, and pivots the tripping lever in order to unlatch the latching point. The impact-type armature of the magnetic short-circuit current release and the thermal bimetallic strip of the overcurrent release both act on the striking lever, and the tripping lever is moved indirectly via the striking lever to its unlatched position.

In known installation switching devices, the response rate of the magnetic release is limited, since it includes a plurality of mechanical subsystems, each of which has a certain amount of mechanical inertia. The current limiting in the event of a short circuit is therefore also limited. Furthermore, in known installation switching devices, temperature compensation is required for the overcurrent release.

For fitting, known circuit breakers are normally mounted on a top-hat rail by means of a quick-release attachment. For electrical protection of telecommunications facilities, a circuit breaker for DC applications is often used, with very fast short-circuit disconnection and overcurrent tripping independently of the temperature. When used in switchgear cabinets, for example for telecommunications infrastructure, 19-inch rack inserts with a specific height are often used. This height has a subdivision unit of 1 U, approximately 44.45 mm. Switching devices for use in these switchgear cabinets should not exceed a height of 1 U. In addition, the switching device should make direct contact with and be mounted on a copper rail. The normal physical size of known circuit breakers therefore cannot be used.

SUMMARY

An exemplary embodiment of the present disclosure provides an electrical installation switching device which includes a housing, and a current path which runs in the housing between a first connecting point and a second connecting point. The exemplary installation switching device also includes at least one first contact point including a first contact lever, where the at least one contact point is configured to at least one of open and close the current path. The exemplary installation switching device also includes an electromagnetic short-circuit current release having a magnetic circuit with an air gap. In addition, the exemplary installation switching device includes an overcurrent release having a switching mechanism operating element which is configured to change from a rest position to a trip position when overcurrent tripping occurs. Furthermore, the exemplary installation switching device includes a switching mechanism including a tripping lever and a striking lever which is configured to be pivoted between a rest position and a trip position. The current path includes at least one second contact point which includes a second contact lever. The second contact lever is arranged at least partially in the air gap in the magnetic circuit to cause, in the event of a short circuit, an electrodynamic force, which leads to rapid opening of the at least one second contact point, to act on the second contact lever due to interaction of flow of current in the current path with magnetic flux within the air gap. The switching mechanism is configured to act, via a first operating connecting line, on the first contact lever to at least one of open the first contact point and keep the first contact point open. In the event of overcurrent tripping, the overcurrent release is configured to act through the switching mechanism and via a second operating connecting line on the switching mechanism to open the first contact point and keep the first contact point open. In the event of short-circuit tripping, the second contact lever is configured to act, via a third operating connecting line, on the switching mechanism to keep the first contact point open.

BRIEF DESCRIPTION OF THE DRAWINGS

Additional refinements, advantages and features of the present disclosure are described in more detail below with reference to exemplary embodiments illustrated in the drawings, in which.

Figure 1:
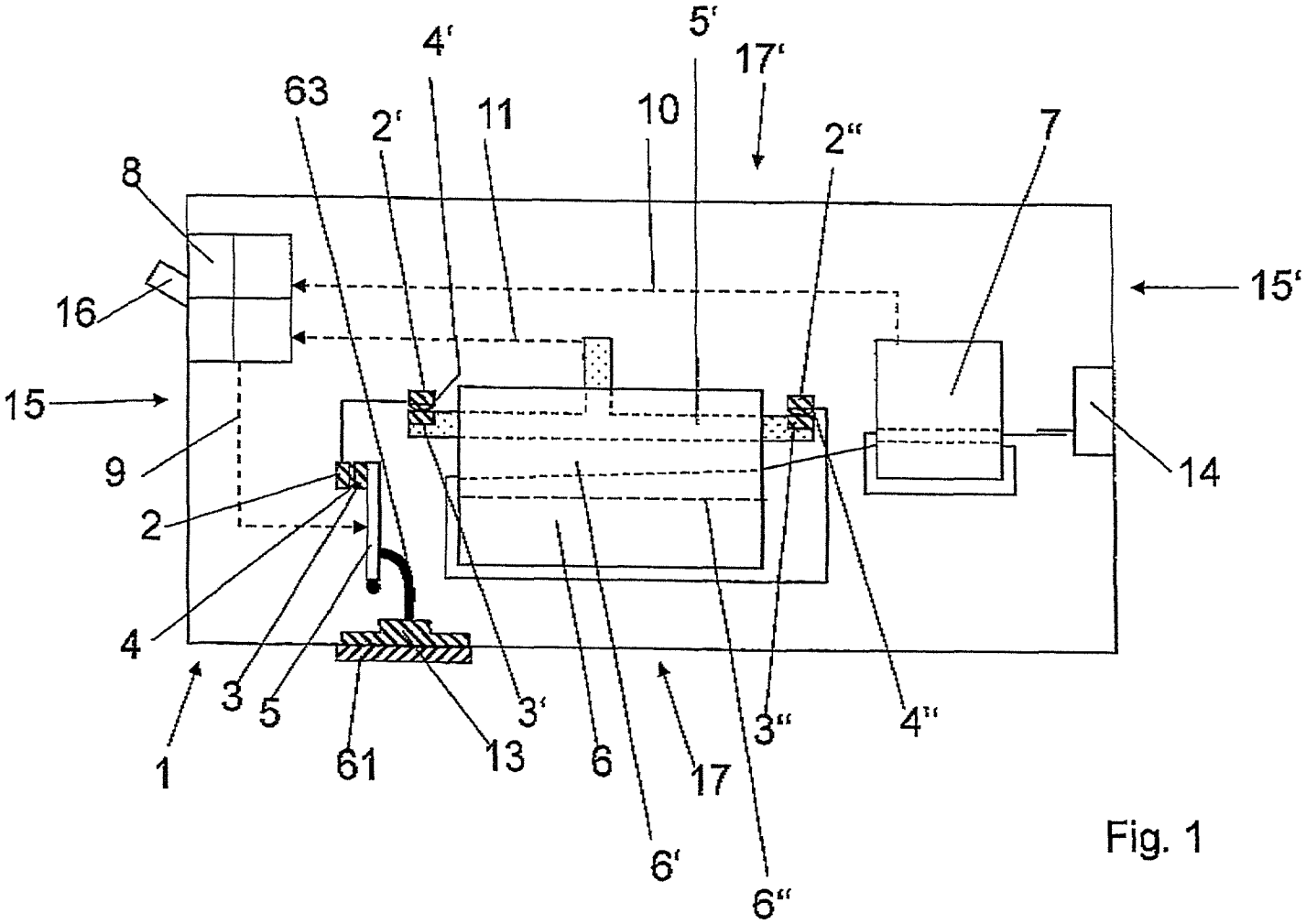
FIG. 1 shows a schematic view of an installation switching device according to an exemplary embodiment of the present disclosure.
Figure 2:
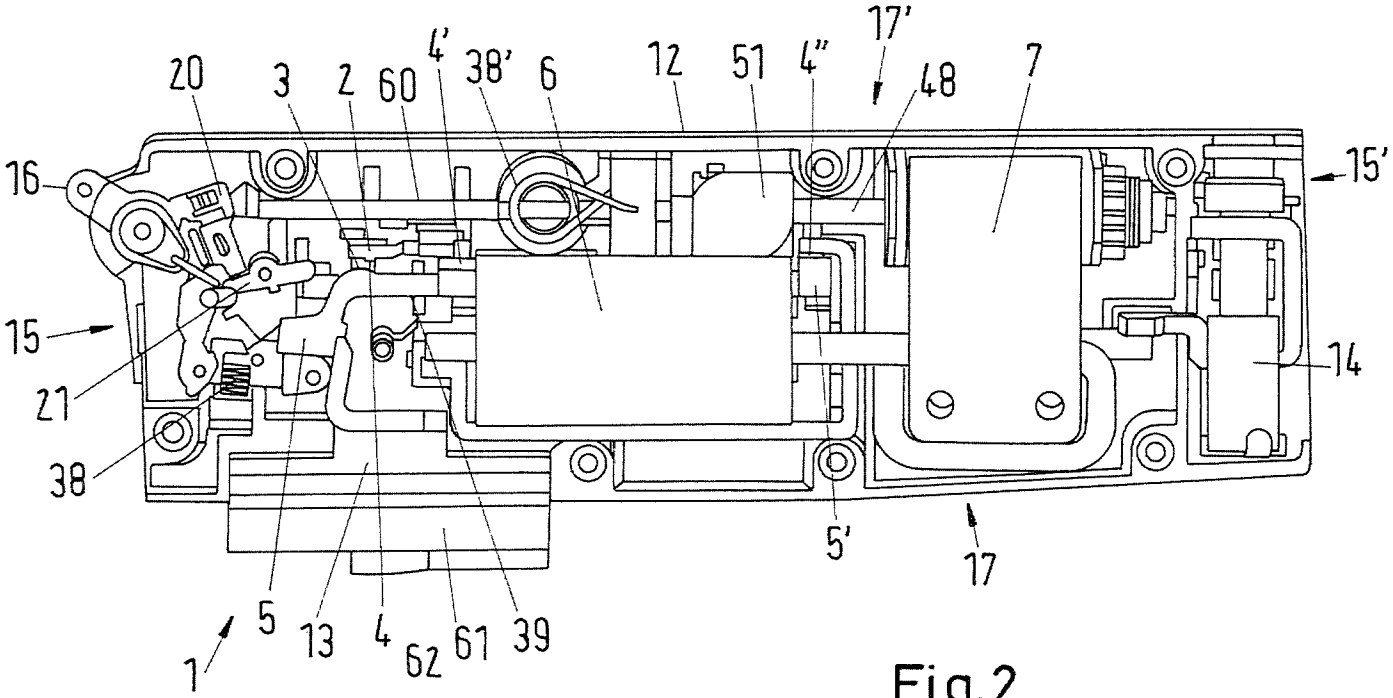
FIG. 2 shows a view into the open housing lower part of an installation switching device according to an exemplary embodiment of the present disclosure.

In the description of exemplary embodiments below, various directions are described to illustrate features of the present disclosure with reference to the orientation of the constituent elements illustrated in the drawings. It is to be understood that the directions used in the following description are exemplary, and the present disclosure is not limited thereto.

DETAILED DESCRIPTION

Exemplary embodiments of the present disclosure provide an installation switching device which achieves a faster and reliable short-circuit current disconnection than can be achieved with known techniques, while furthermore allowing installation of the installation switching device in a 19-inch rack insert.

Exemplary embodiments of the present disclosure provide an electrical installation switching device which includes a current path which runs in a housing between a first connecting point and a second connecting point. The circuit path is configured to be opened and closed at at least one first contact point which includes a first contact lever. The exemplary installation switching device also includes an electromagnetic short-circuit current release having a magnetic circuit with an air gap. The exemplary installation switching device also includes an overcurrent release having a switching mechanism operating element which changes from a rest position to a trip position when overcurrent tripping occurs. In addition, the exemplary installation switching device includes a switching mechanism which includes a tripping lever as well as a striking lever which can be pivoted between a rest position and a trip position.

In accordance with an exemplary embodiment of the present disclosure, the current path includes at least one second contact point which includes a second contact lever. The second contact lever is arranged at least partially in the air gap in the magnetic circuit such that, in the event of a short circuit, an electrodynamic force which leads to rapid opening of the at least one second contact point can act on the second contact lever as a result of the interaction of the current flow with the magnetic flux within the air gap. The switching mechanism acts via a first operating connecting line on the first contact lever in order to open the first contact point and/or to keep it open. In the event of overcurrent tripping, the overcurrent release acts through the switching mechanism and via a second operating connecting line on the switching mechanism in order to open the first contact point and keep it open. In the event of short-circuit tripping, the second contact lever acts via a third operating connecting line on the switching mechanism in order to keep the first contact point open.

The installation switching device according to the disclosure uses a switching mechanism based on that described in DE 10 2008 006 863 A1.

An installation switching device according to the present disclosure has the advantage that short-circuit currents are disconnected more quickly than in a known device. In the event of overcurrent tripping, the contact point is kept open permanently after the switching mechanism has been unlatched, where reconnection after renewed latching of the switching mechanism, etc., is still available, in the normal manner.

In accordance with an exemplary embodiment, the magnetic short-circuit current tripping included in the installation switching device according to the present disclosure advantageously provides that the magnetic flux or field of the magnetic circuit and the second contact lever can interact directly. This allows the second contact point to be opened much more quickly than in the case of impact-type armature systems as used in known circuit breakers in which, as already mentioned, the mechanical inertia of the moving components involved limits the tripping rate. In the case of magnetic short-circuit current tripping included in the installation switching device according to the present disclosure, a force which results from the force effect, which is known as the Lorentz force, of a magnetic field on an electrical charge which is moving in the field acts on the second contact lever. This force acts directly, without the interposition of mechanical components such as a moving armature or striking pin. If the second contact point has been opened quickly, the current path is interrupted. According to an exemplary embodiment, in order to ensure that the contact point is kept open permanently, the second contact lever acts on the switching mechanism, which then opens the first contact point. While the short-circuit current has been interrupted, the magnetic force on the second contact lever will disappear. The current path is kept open permanently via the first contact point. This also applies during manual disconnection. In the event of overcurrent tripping, the current path is disconnected and kept open via the switching mechanism and the first contact point. This ensures reliable short-circuit current and overcurrent disconnection. According to an exemplary embodiment, the introduction of at least two series-connected contact points in order to distribute the tasks of rapid first disconnection and permanently keeping two different contact points open in the event of a short circuit for the first time allows all the required subsystems and components to be constructed in a very low housing with the required height of 44.45 mm—this is because, in contrast, a conventional switch has a height of at least 60 mm.

According to an exemplary embodiment of the present disclosure, the switching mechanism operating element of the overcurrent release is coupled to an overcurrent magnetic circuit. The force which acts on the switching mechanism operating element is produced by the magnetic field of the overcurrent. The switching mechanism operating element is coupled to an electromagnetic damping element in order to set the tripping delay time. The switching mechanism operating element is coupled to a setting element in order to set the overcurrent tripping threshold. In this exemplary embodiment, the overcurrent tripping can also be in the form of a magnetic tripping system. This arrangement has the advantage that the overcurrent tripping can be carried out independently of the temperature. This is because, in the case of known thermal bimetallic strip releases, the bimetallic strip is also deformed when there is a change in the ambient temperature, as a result of which an overcurrent release such as this generally has to be coupled to a compensation apparatus. On the contrary, the magnetic overcurrent release used in the installation switching device according to the present disclosure is not dependent on the temperature.

According to an exemplary embodiment of the present disclosure, the housing can have an essentially cuboid shape. The cupoid shape of the housing can include a front narrow face and a rear narrow face, and upper and lower longitudinal faces. An operating lever is provided on the front narrow face for manual operation of the switching mechanism. The short-circuit current release and the overcurrent release are connected to the switching mechanism, which is arranged on the front narrow face. The cuboid shape of the housing allows for the installation switching device to be used in switchgear cabinets with 19-inch rack inserts.

With respect to the arrangement of the functional assemblies in the interior of the housing of an installation switching device according to the present disclosure, an exemplary embodiment provides that the short-circuit current release and the overcurrent release are arranged one behind the other in the housing, seen in the flow direction of the current through the current path. This makes it possible to utilize the space particularly well.

According to an exemplary embodiment of the present disclosure, the first connecting point can be in the form of a connecting plate for screwing to a contact rail. This arrangement allows the link to be made to a copper rail in the switchgear cabinet.

According to an exemplary embodiment of the present disclosure, a first coupling rod is provided for coupling the switching mechanism operating element of the overcurrent release to the tripping lever. In an exemplary embodiment, the switching mechanism operating element is provided at its free end with a control cam body which has a control cam. The first coupling rod, supported at a first end on the control cam, is pressed by its second end against the tripping lever when the switching mechanism operating element moves to the trip position. In this case, in accordance with an exemplary embodiment of the present disclosure, the switching mechanism operating element can be a shaft which is borne such that it can rotate about its longitudinal axis. This allows force to be transmitted efficiently between the overcurrent release directly to the tripping lever. Since the magnetic overcurrent release has a rotating shaft as the switching mechanism operating element according to an exemplary embodiment of the present disclosure, the rotation of the shaft is converted to a longitudinal forward movement of the coupling rod for coupling to the switching mechanism. The moments and forces which are created during this process can be absorbed well by the housing without the sub-components being excessively mechanically loaded.

According to an exemplary embodiment, the resetting force of a first contact compression spring acts on the first contact lever in the direction of the first stationary contact piece. The first contact compression spring can be, for example, a contact compression spring arrangement as described in the switching mechanism according to DE 10 2008 006 863 A1.

According to an exemplary embodiment of the present disclosure, the second contact lever can be in the form of a moving contact link which is provided with two moving contact pieces which interact with two stationary contact pieces in order to form a double contact point. The resetting force of a second contact compression spring acts on the second contact lever in the direction of the stationary contact pieces. This results in a double-contact point, which has the advantage that each individual partial contact point is less severely loaded in the event of short-circuit current disconnection than in the case of a single contact point.

According to an exemplary embodiment of the present disclosure, a second coupling rod is provided for coupling the moving contact link to the striking lever of the switching mechanism. In this case, in one advantageous aspect of the present disclosure, a linear movement of the moving contact link during opening of the second contact point is transmitted by means of the second coupling rod to a free end of the striking lever, and causes the striking lever to pivot as a result. The physical disconnection of the point at which the short-circuit current release acts on the switching mechanism at the striking lever from the point at which the overcurrent release acts on the switching mechanism on the tripping lever has the advantage that this results in a design which is flat overall and fits into a low housing with a low physical height of 44.45 mm, for example.

Further advantageous refinements and improvements of the present disclosure are described below with reference to the drawings.

FIG. 1 shows a schematic view of an installation switching device 1 according to an exemplary embodiment of the present disclosure. In the example of FIG. 1, the installation switching device 1 is illustrated as a circuit breaker. The installation switching device 1 includes a housing 12. The housing 12 has an essentially cuboid shape, having a front narrow face 15 and a rear narrow face 15', as well as an upper longitudinal face 17 and a lower longitudinal face 17'. An operating lever 16 is provided on the front narrow face 15 for manual operation of the switching mechanism 8, and the short-circuit current release 6 and the overcurrent release 7 are connected to the switching mechanism 8, which is arranged on the front narrow face 15.

The short-circuit current release 6 may be designed, for example, as described in WO 2010/130414 A1. In addition, the overcurrent release 7 may operate, for example, as described in WO 2010/133346 A1. The switching mechanism 8 may operate, for example, as described in DE 10 2008 006 863 A1.

A current path runs in the housing 12 between a first connecting point 13 on the lower longitudinal face 17 and a second connecting point 14 on the rear narrow face 15'. The current path can be opened and closed at a first contact point 4, which includes a first contact lever 5 as well as a first stationary contact piece 2 and a first moving contact piece 3.

The electromagnetic short-circuit current release 6 includes a magnetic circuit with an air gap. The overcurrent release 7 includes a switching mechanism operating element 48 which changes from a rest position to a trip position when overcurrent tripping occurs. The switching mechanism 8 includes a tripping lever 20 as well as a striking lever 21 which can be pivoted between a rest position and a trip position.

The current path includes a second contact point, in the form of a double-contact point 4', 4" with a second contact lever, also referred to as a double-contact link 5'. The second contact lever 5' is arranged at least partially in the air gap 6' in the magnetic circuit such that, in the event of a short circuit, an electrodynamic force which leads to rapid opening of the second contact point 4', 4" can act on the second contact lever 5' as a result of the interaction of the current flow with the magnetic flux within the air gap 6' (reference symbol 6" denotes the lower edge of the air gap 6'). The switching mechanism 8 acts via a first operating connecting line 9 on the first contact lever 5 in order to open the first contact point 4 and/or to keep it open. In the event of overcurrent tripping, the overcurrent release 7 acts through the switching mechanism 8 and via a second operating connecting line 10 on the switching mechanism 8 in order to open the first contact point 4 and keep it open. In the event of short-circuit tripping, the second contact lever 5' acts via a third operating connecting line 11 on the switching mechanism 8 in order to keep the first contact point 4 open.

The overcurrent release 7 is a magnetically active overcurrent release, as described, for example, in WO 2010/133346 A1. A switching mechanism operating element in the form of a shaft 48 which is borne such that it can rotate about its longitudinal axis is formed thereon. Furthermore, the overcurrent release 7 includes a setting element in the form of a restraint spring, for example. In the event of an overcurrent, the magnetic circuit of the overcurrent release exerts a torque on the shaft 48 and attempts to rotate it in the clockwise direction. This occurs only when the drive torque acting on the shaft 48 exceeds the restraint torque exerted on the shaft 48 by the restraint spring. The response threshold of the overcurrent release 7 is therefore adjustable.

A control cam body 51 is formed at the free end of the shaft 48. This control cam body 51 is approximately in the form of a cylinder, which is cut open in places at the side. A control cam is formed in the control cam body 51. The first coupling rod 60 is supported at a first end on the control cam. During rotation of the shaft 48, the control cam ensures that the second end of the first coupling rod 60 is pressed against the tripping lever 20, in order to unlatch the switching mechanism 8 and to open the first contact point 4.

The rotary movement of the control cam body 51 with the control cam is converted via the first coupling rod 60 to a linear movement, and the switching mechanism 8 unlatches in the event of overcurrent tripping. The first contact point 4 opens and interrupts the circuit.

In the event of short-circuit tripping, the contact link 5' opens, and the switching mechanism 8 is unlatched via the coupling of the short-circuit release 6 to the striking lever 21 by means of a second coupling rod 39. The contact link 5' falls back to its original position again, driven by the second contact compression spring 38', for example, a leg spring, which acts on an attachment on the contact link 5', which projects upwards from the magnetic release.

In the event of an overcurrent or short circuit, and during switching during operation, the circuit is always disconnected via the first contact point 4.

Connection is made to the copper rail 61, which can be a component of a 19-inch rack insert, via the first connecting point 13. The device is screwed to the copper rail 61 by means of a screw 62. The contact between the copper rail 61 and the first connecting point 13 is provided on the connecting face to the copper rail with a groove system, in order to achieve a reliable contact. A braid 63 is welded onto the opposite side in the housing, and is connected to the first contact lever 5.

The installation switching device described above can be used particularly advantageously for protection of circuits using a low rated voltage, for example of 60V, AC or DC, because no arc quenching device is required since a short-circuit current is disconnected very quickly by the electrodynamic short-circuit current release 6. Since the anode-cathode voltage is already sufficiently great that it exceeds the 60V rated voltage such that the current is interrupted in this way, no additional arc voltage is required in order to counteract the voltage which is present at the terminals for disconnection. The installation switching device described above can likewise be used advantageously in applications where the ambient temperature fluctuates widely, because no temperature compensation is required for the overcurrent release, because the overcurrent release operates on a magnetic principle.

The present disclosure also includes any other desired combinations of exemplary embodiments as well as individual refinement features or developments, provided that these are not mutually contradictory.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. An electrical installation switching device comprising:

a housing;

a current path which runs in the housing between a first connecting point and a second connecting point;

at least one first contact point including a first contact lever, the at least one first contact point being configured to at least one of open and close the current path;

an electromagnetic short-circuit current release including a magnetic circuit with an air gap;

an overcurrent release including a switching mechanism operating element which is configured to change from a rest position to a trip position when overcurrent tripping occurs;

a switching mechanism including a tripping lever and a striking lever which is configured to be pivoted between a rest position and a trip position; and a first coupling rod configured to couple the switching mechanism operating element to the tripping lever, wherein the current path includes at least one second contact point which includes a second contact lever, wherein the second contact lever is arranged at least partially in the air gap in the magnetic circuit to cause, in the event of a short circuit, an electrodynamic force, which leads to rapid opening of the at least one second contact point, to act on the second contact lever due to interaction of flow of current in the current path with magnetic flux within the air gap, wherein the switching mechanism is configured to act, via a first operating connecting line, on the first contact lever to at least one of open the first contact point and keep the first contact point open, wherein, in the event of overcurrent tripping, the overcurrent release is configured to act through the switching mechanism and via a second operating connecting line on the switching mechanism to open the first contact point and keep the first contact point open, and wherein, in the event of short-circuit tripping, the second contact lever is configured to act, via a third operating connecting line, on the switching mechanism to keep the first contact point open.

2. The electrical installation switching device according to claim 1, wherein the switching mechanism operating element includes at its free end a control cam body which has a control cam, and wherein the first coupling rod, which is supported at a first end on the control cam, is pressed by its second end against the tripping lever when the switching mechanism operating element moves to the trip position.

3. The electrical installation switching device according to claim 1, wherein the switching mechanism operating element comprises a shaft which is borne to be rotatable about its longitudinal axis.

4. The electrical installation switching device according to claim 1, wherein the first contact point includes a first stationary contact piece, and wherein the installation switching device comprises a first contact compression spring configured to apply a resetting force to act on the first contact lever in a direction of the first stationary contact piece.

5. The electrical installation switching device according to claim 1, wherein the first contact point includes a first stationary contact piece, and the second contact point includes a second stationary contact piece, wherein the second contact lever is in the form of a moving contact link which includes two moving contact pieces which are configured to interact with the first and second stationary contact pieces to form a double contact point, and wherein the installation switching device comprises a second contact compression spring configured to apply a resetting force to act on the second contact lever in a direction of the stationary contact pieces.

6. The electrical installation switching device according to claim 5, comprising:

a second coupling rod configured to couple the moving contact link to the striking lever of the switching mechanism.

7. The electrical installation switching device according to claim 6, wherein the second coupling rod is configured to transmit a linear movement of the moving contact link during opening of the second contact point to a free end of the striking lever, and cause the striking lever to pivot.

8. The electrical installation switching device according to claim 1, wherein the first contact point, the short-circuit current release and the overcurrent release are arranged one behind the other in the housing in a flow direction of current through the current path.

9. The electrical installation switching device according to claim 8, wherein the housing has an essentially cuboid shape including a front narrow face, a rear narrow face, an upper longitudinal face, and a lower longitudinal face, wherein the front narrow face includes an operating lever for manual operation of the switching mechanism, and wherein the short-circuit current release and the overcurrent release are connected to the switching mechanism, which is arranged on the front narrow face.

10. The electrical installation switching device according to claim 9, wherein the first connecting point is in the form of a connecting plate for screwing to a contact rail.

11. The electrical installation switching device according to claim 1, comprising:

an overcurrent magnetic circuit to which the switching mechanism operating element of the overcurrent release is coupled; and wherein the force which acts on the switching mechanism operating element is produced by a magnetic field of the overcurrent, wherein the switching mechanism operating element is coupled to an electromagnetic damping element to set a tripping delay time, and wherein the switching mechanism operating element is coupled to a setting element to set an overcurrent tripping threshold.

12. The electrical installation switching device according to claim 2, wherein the first contact point includes a first stationary contact piece, and wherein the installation switching device comprises a first contact compression spring configured to apply a resetting force to act on the first contact lever in a direction of the first contact piece.

13. The electrical installation switching device according to claim 4, wherein the second contact point includes a second stationary contact piece, wherein the second contact lever is in the form of a moving contact link which includes two moving contact pieces which are configured to interact with the first and second stationary contact pieces to form a double contact point, and wherein the installation switching device comprises a second contact compression spring configured to apply a resetting force to act on the second contact lever in a direction of the stationary contact pieces.

14. The electrical installation switching device according to claim 13, comprising:

a second coupling rod configured to couple the moving contact link to the striking lever of the switching mechanism.

15. The electrical installation switching device according to claim 14, wherein the second coupling rod is configured to transmit a linear movement of the moving contact link during opening of the second contact point to a free end of the striking lever, and cause the striking lever to pivot.

16. An electrical installation switching device comprising:

a housing;

a current path which runs in the housing between a first connecting point and a second connecting point;

at least one first contact point including a first contact lever, the at least one first contact point being configured to at least one of open and close the current path;

an electromagnetic short-circuit current release including a magnetic circuit with an air gap;

an overcurrent release including a switching mechanism operating element which is configured to change from a rest position to a trip position when overcurrent tripping occurs;

a switching mechanism including a tripping lever and a striking lever which is configured to be pivoted between a rest position and a trip position, wherein the current path includes at least one second contact point which includes a second contact lever, wherein the second contact lever is arranged at least partially in the air gap in the magnetic circuit to cause, in the event of a short circuit, an electrodynamic force, which leads to rapid opening of the at least one second contact point, to act on the second contact lever due to interaction of flow of current in the current path with magnetic flux within the air gap, wherein the switching mechanism is configured to act, via a first operating connecting line, on the first contact lever to at least one of open the first contact point and keep the first contact point open, wherein, in the event of overcurrent tripping, the overcurrent release is configured to act through the switching mechanism and via a second operating connecting line on the switching mechanism to open the first contact point and keep the first contact point open, wherein, in the event of short-circuit tripping, the second contact lever is configured to act, via a third operating connecting line, on the switching mechanism to keep the first contact point open, wherein the first contact point includes a first stationary contact piece, and the second contact point includes a second stationary contact piece, wherein the second contact lever is in the form of a moving contact link which includes two moving contact pieces which are configured to interact with the first and second stationary contact pieces to form a double contact point, and wherein the installation switching device comprises:

a second coupling rod configured to couple the moving contact link to the striking lever of the switching mechanism; and a second contact compression spring configured to apply a resetting force to act on the second contact lever in a direction of the stationary contact pieces.

17. The electrical installation switching device according to claim 16, wherein the second coupling rod is configured to transmit a linear movement of the moving contact link during opening of the second contact point to a free end of the striking lever, and cause the striking lever to pivot.

18. An electrical installation switching device comprising:

a housing;

a current path which runs in the housing between a first connecting point and a second connecting point;

at least one first contact point including a first contact lever, the at least one first contact point being configured to at least one of open and close the current path;

an electromagnetic short-circuit current release including a magnetic circuit with an air gap;

an overcurrent release including a switching mechanism operating element which is configured to change from a rest position to a trip position when overcurrent tripping occurs; and a switching mechanism including a tripping lever and a striking lever which is configured to be pivoted between a rest position and a trip position, wherein the current path includes at least one second contact point which includes a second contact lever, wherein the second contact lever is arranged at least partially in the air gap in the magnetic circuit to cause, in the event of a short circuit, an electrodynamic force, which leads to rapid opening of the at least one second contact point, to act on the second contact lever due to interaction of flow of current in the current path with magnetic flux within the air gap, wherein the switching mechanism is configured to act, via a first operating connecting line, on the first contact lever to at least one of open the first contact point and keep the first contact point open, wherein, in the event of overcurrent tripping, the overcurrent release is configured to act through the switching mechanism and via a second operating connecting line on the switching mechanism to open the first contact point and keep the first contact point open, wherein, in the event of short-circuit tripping, the second contact lever is configured to act, via a third operating connecting line, on the switching mechanism to keep the first contact point open, and wherein the first contact point, the short-circuit current release and the overcurrent release are arranged one behind the other in the housing in a flow direction of current through the current path.

19. The electrical installation switching device according to claim 18, wherein the housing has an essentially cuboid shape including a front narrow face, a rear narrow face, an upper longitudinal face, and a lower longitudinal face, wherein the front narrow face includes an operating lever for manual operation of the switching mechanism, and wherein the short-circuit current release and the overcurrent release are connected to the switching mechanism, which is arranged on the front narrow face.

20. The electrical installation switching device according to claim 19, wherein the first connecting point is in the form of a connecting plate for screwing to a contact rail.

21. An electrical installation switching device comprising:

a housing;

a current path which runs in the housing between a first connecting point and a second connecting point;

at least one first contact point including a first contact lever, the at least one first contact point being configured to at least one of open and close the current path;

an electromagnetic short-circuit current release including a magnetic circuit with an air gap;

an overcurrent release including a switching mechanism operating element which is configured to change from a rest position to a trip position when overcurrent tripping occurs;

a switching mechanism including a tripping lever and a striking lever which is configured to be pivoted between a rest position and a trip position; and an overcurrent magnetic circuit to which the switching mechanism operating element of the overcurrent release is coupled;

wherein the current path includes at least one second contact point which includes a second contact lever, wherein the second contact lever is arranged at least partially in the air gap in the magnetic circuit to cause, in the event of a short circuit, an electrodynamic force, which leads to rapid opening of the at least one second contact point, to act on the second contact lever due to interaction of flow of current in the current path with magnetic flux within the air gap, wherein the switching mechanism is configured to act, via a first operating connecting line, on the first contact lever to at least one of open the first contact point and keep the first contact point open, wherein, in the event of overcurrent tripping, the overcurrent release is configured to act through the switching mechanism and via a second operating connecting line on the switching mechanism to open the first contact point and keep the first contact point open, wherein, in the event of short-circuit tripping, the second contact lever is configured to act, via a third operating connecting line, on the switching mechanism to keep the first contact point open, wherein the force which acts on the switching mechanism operating element is produced by a magnetic field of the overcurrent, wherein the switching mechanism operating element is coupled to an electromagnetic damping element to set a tripping delay time, and wherein the switching mechanism operating element is coupled to a setting element to set an overcurrent tripping threshold.

* * * * *